US010399239B2

(12) United States Patent
Forrer et al.

(10) Patent No.: US 10,399,239 B2
(45) Date of Patent: Sep. 3, 2019

(54) CUTTING DEVICE AND FILM DISPENSER

(71) Applicant: ALU-VERTRIEBSSTELLE AG, Kreuzlingen (CH)

(72) Inventors: Beat Forrer, Uttwil (CH); Max Walder, Uttwil (CH)

(73) Assignee: ALU-VERTRIEBSSTELLE AG, Kreuzlingen (CH)

( * ) Notice: Subject to any disclaimer, the term of this patent is extended or adjusted under 35 U.S.C. 154(b) by 273 days.

(21) Appl. No.: 15/402,467

(22) Filed: Jan. 10, 2017

(65) Prior Publication Data

US 2017/0217037 A1 Aug. 3, 2017

(30) Foreign Application Priority Data

Jan. 29, 2016 (CH) ..... 0112/16

(51) Int. Cl.

| | |
|---|---|
| ***B26D 1/06*** | (2006.01) |
| ***B26D 7/00*** | (2006.01) |
| ***B65H 35/06*** | (2006.01) |
| ***B65D 83/08*** | (2006.01) |
| ***B65H 35/00*** | (2006.01) |

(52) U.S. Cl.

CPC ..... *B26D 1/065* (2013.01); *B26D 7/0006* (2013.01); *B65D 83/0882* (2013.01); *B65H 35/008* (2013.01); *B65H 35/06* (2013.01)

(58) Field of Classification Search

CPC . Y10T 83/8821; Y10T 83/8822; B65H 35/00; B65H 35/006; B65H 35/002; B65H 35/0073; B65H 35/008

USPC ..... 83/614

See application file for complete search history.

(56) References Cited

U.S. PATENT DOCUMENTS

| | | | | | |
|---|---|---|---|---|---|
| 2,252,888 | A * | 8/1941 | Goserud | A01G 3/06 | 172/16 |
| 2,520,000 | A * | 8/1950 | Dettman | B26D 3/30 | 30/124 |
| 2,823,969 | A * | 2/1958 | Traver | B65H 35/0086 | 312/34.8 |
| 2,921,493 | A * | 1/1960 | Emmert | B65H 35/0026 | 83/611 |
| 3,137,192 | A * | 6/1964 | McNeill | B26D 1/105 | 30/123 |
| 3,142,217 | A * | 7/1964 | Busse | B26D 1/105 | 83/375 |
| 3,142,426 | A * | 7/1964 | Busse | B65D 83/0882 | 225/43 |
| 3,370,497 | A * | 2/1968 | Busse | B21C 47/34 | 83/455 |
| 4,001,934 | A * | 1/1977 | Bell | B26B 27/00 | 30/124 |
| 4,046,044 | A * | 9/1977 | Paterson | B26D 1/205 | 83/468 |

(Continued)

FOREIGN PATENT DOCUMENTS

| | | |
|---|---|---|
| CH | 699230 | 1/2010 |
| WO | 2006096187 | 9/2006 |

*Primary Examiner* — Andrea L Wellington
*Assistant Examiner* — Richard D Crosby, Jr.
(74) *Attorney, Agent, or Firm* — Volpe and Koenig, P.C.

(57) ABSTRACT

The film dispenser includes a folding box (51) having an outer guide wall (55) and an inner guide wall (65) which both have a guide gap (53, 63), and a cutting device (1) which is configured to be displaced in a cutting direction (S) in a manner guided in the two guide gaps (53, 63) at the two guide walls (55, 65).

11 Claims, 2 Drawing Sheets

(56) References Cited

U.S. PATENT DOCUMENTS 4,156,382 A * 5/1979 Baker ..... B29C 66/861 156/510
4,196,647 A * 4/1980 Fish ..... B26D 1/345 83/175
4,197,774 A * 4/1980 Singh ..... B26D 1/045 83/374
4,210,043 A * 7/1980 Urion ..... B26D 1/105 83/175
4,608,894 A * 9/1986 Lee ..... B65H 35/0026 83/322
4,787,284 A * 11/1988 Chen ..... B26D 1/045 83/614
4,960,022 A * 10/1990 Chuang ..... B26D 1/105 83/175
5,036,740 A * 8/1991 Tsai ..... B26D 1/105 83/455
5,044,241 A * 9/1991 Labrecque ..... B26D 1/185 83/489
5,103,710 A * 4/1992 Ross ..... B26D 1/045 83/485
5,186,376 A * 2/1993 Scharf ..... B26D 7/2614 225/42
5,398,576 A * 3/1995 Chiu ..... B26D 1/045 83/455
5,440,961 A * 8/1995 Lucas, Jr. ..... B26D 1/185 83/455
5,524,515 A * 6/1996 Boda ..... B23D 35/008 83/455
5,768,968 A * 6/1998 Park ..... B26D 1/045 83/418
5,819,618 A * 10/1998 Rodriguez ..... B26D 1/185 83/56
6,223,639 B1 * 5/2001 Chen ..... B26D 1/045 225/93
7,921,756 B2 * 4/2011 Vegliante ..... B26D 1/065 83/374
8,132,490 B2 * 3/2012 Peterson ..... B26D 7/015 83/613
8,424,435 B2 * 4/2013 Sudmalis ..... B26D 7/22 83/485
8,584,565 B1 * 11/2013 Hortelius ..... A22C 11/00 83/613
D750,160 S * 2/2016 Baldwin ..... D18/34.9
10,016,906 B2 * 7/2018 Baba ..... B26D 7/025
2002/0117038 A1 * 8/2002 Vegliante ..... B26D 1/045 83/578
2003/0140761 A1 * 7/2003 Schulz ..... B23D 35/008 83/614
2004/0040429 A1 * 3/2004 Nichols ..... B26D 1/045 83/455
2004/0237746 A1 * 12/2004 Schultz ..... B26D 1/045 83/614
2005/0005755 A1 * 1/2005 Turvey ..... B26D 1/04 83/614
2005/0034584 A1 * 2/2005 Antal ..... B26D 1/045 83/614
2005/0035133 A1 * 2/2005 Gerulski ..... B26D 1/045 221/31
2005/0166738 A1 * 8/2005 Hsu ..... B26D 7/015 83/614
2006/0202079 A1 * 9/2006 Pavlik ..... B26D 1/045 242/562
2007/0000935 A1 * 1/2007 Pavlik ..... B26D 1/045 221/33
2007/0044617 A1 * 3/2007 Pavlik ..... B26D 1/045 83/614
2007/0173394 A1 * 7/2007 Lee ..... B26D 1/045 493/68
2009/0000442 A1 * 1/2009 Peterson ..... B26D 7/015 83/56
2009/0293695 A1 * 12/2009 Sacchetta ..... B26D 1/045 83/614
2014/0096659 A1 * 4/2014 Choi ..... B65H 35/002 83/485
2015/0107192 A1 * 4/2015 Loibl ..... B26D 1/105 53/389.3
2017/0217037 A1 * 8/2017 Forrer ..... B26D 1/065

* cited by examiner

CUTTING DEVICE AND FILM DISPENSER

INCORPORATION BY REFERENCE

The following documents are incorporated herein by reference as if fully set forth: Swiss Patent Application No. 00112/16, filed Jan. 29, 2016.

BACKGROUND

The subject of the invention is a cutting device and a film dispenser.

Rolled-up films such as plastic wrap, for example, which are used in private households or in the catering sector, are often stored in containers made of cardboard or corrugated board. As a rule, such containers are also configured at the same time as dispensers from which film sections can be pulled out and severed by a separating device.

The patent application CH 699230 A2 discloses a film dispenser which comprises a housing having such a separating device. The housing is manufactured as a disposable container made of cardboard or corrugated board. The separating device comprises a separate plastic profile which is fastened to the upper front edge of the housing, and a cutting device, having a cutting blade, mounted in a displaceable manner on this plastics profile. The housing and separating device of such film dispensers are comparatively stable and easy to use. However, compared with film dispensers which are manufactured from thinner cardboard and comprise a tear-off edge as the separating device, the material outlay and production costs are much higher. From an environmental point of view, there is also room for improvement for such dispensers, if they are used as disposable devices which are disposed of after all of the store of film has been used up.

WO2006096187 discloses a further film dispenser, the housing of which is configured as a folded cardboard box. A longitudinal gap in the lid or generally in a longitudinal wall of the folding box serves as a guide means for a cutting device. The cutting device comprises a neck having two blades which is arranged between a foot part and a head part. The foot part and head part are much wider and longer than the width of the guide gap, which corresponds approximately to the width of the neck transversely to the cutting direction. In such film dispensers, even a slight rotation of the cutting device during displacement along the guide gap can cause the front blade in the displacement direction to damage the longitudinal wall of the folding box adjoining the guide gap. This undesired effect is particularly pronounced when the folding box is manufactured from comparatively thin-walled cardboard and/or when the cutting device is mounted with too much play on the longitudinal wall having the guide gap.

In order to attach the cutting device to the longitudinal wall at the guide gap, the cutting device can be configured in two parts, wherein the foot part is fastened to the neck from the inside by a snap connection after it has been guided through the guide gap in the longitudinal wall from the outside. The production and assembly of such cutting devices directly on the housing are complicated and expensive.

Alternatively, the longitudinal gap can comprise a larger opening at one of its ends for introducing the cutting device. This requires unnecessarily long housing lengths and also harbors the risk of cutting devices jumping out of the guide in the region of the openings and being lost.

SUMMARY

Therefore, it is an object of the present invention to create a cutting device and a film dispenser having a cutting device, which are cost-effective to produce and easy to use.

This object is achieved by a cutting device and by a film dispenser including one or more features of the invention.

BRIEF DESCRIPTION OF THE DRAWINGS

An exemplary embodiment of the invention is described in more detail in the following text with reference to a number of figures, in which.

DETAILED DESCRIPTION OF THE PREFERRED EMBODIMENTS

Figure 7:
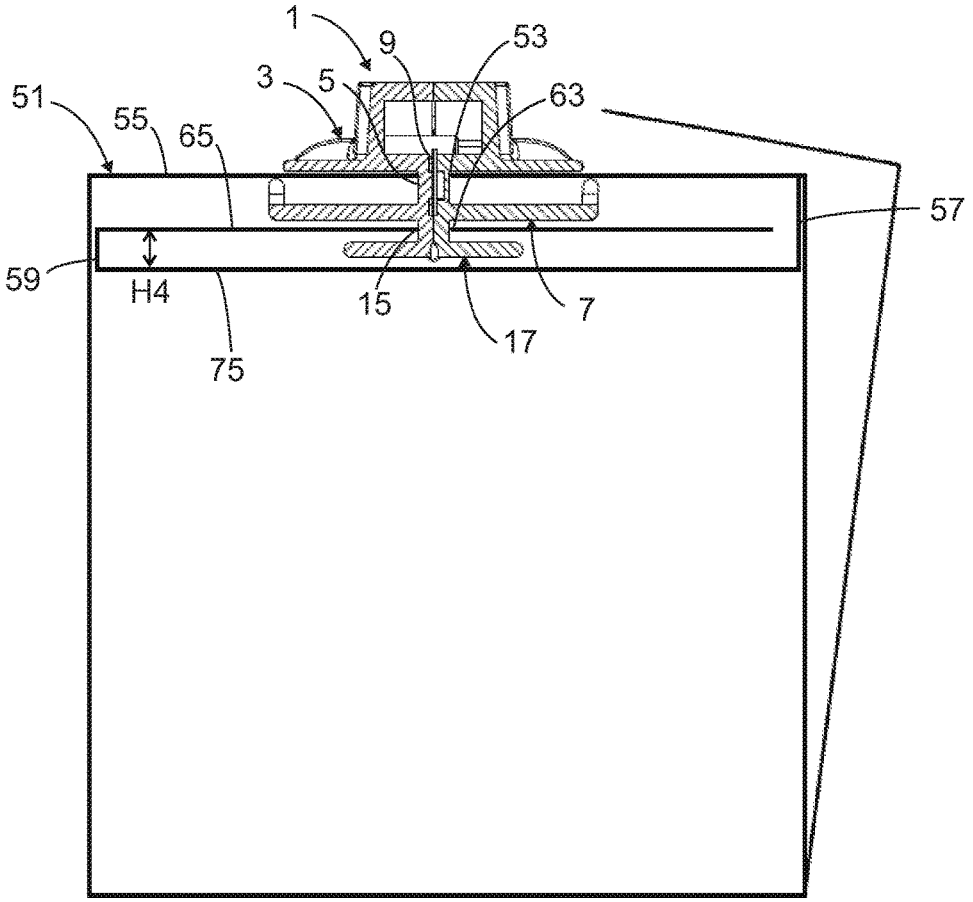
FIG. 7 shows a cross section through a dispenser in the region of the cutting device.

FIGS. 1 to 4 illustrate a preferred embodiment of a cutting device 1 configured in accordance with the invention from different viewing directions. It comprises a head part 3 having a sliding base 3*a* and having a grip 3*d*. The grip 3*d* serves to manually displace the cutting device 1 in a cutting direction S along a first guide gap 53 in an outer guide wall 55 of a folding box 51 when the cutting device 1 is held in a displaceable manner on the folding box 51 (FIG. 7). Unless stated otherwise in the present document, the expression "in the cutting direction S" should be understood as also including the opposite direction to the cutting direction S. The sliding base 3*a* has a flat sliding portion 3*b* and two end regions 3*c* that are located opposite one another in the cutting direction S and are bent upwards in the manner of a shovel. These end regions 3*c* and the rounded corners of the sliding base 3*a* help to prevent a film to be cut from catching or sticking to the head part 3 when the cutting device 1 is displaced in the cutting direction S. In the cutting direction S, the sliding base 3*a* extends along a length L1 which is preferably in the range from 15 mm to 30 mm, and is for example 20 mm. The width B1 of the sliding base 3*a* preferably corresponds approximately to the length L1. A first neck portion 5 projects downward in the middle of the sliding portion 3*b*, the width B2 of said first neck portion transversely to the cutting direction S corresponding approximately to the width of the first guide gap 53 in the folding box 51. When the cutting device 1 has been mounted on the folding box 51, the first neck portion 5 projects through the first guide gap 53 into the interior of the folding box 51 with little play. Accordingly, the first neck portion 5 acts as a guide which prevents or limits movements of the cutting device 1 in translation transversely to the cutting direction S but allows movements thereof in translation in the cutting direction S.

The cutting device 1 furthermore comprises a first guide member 7 having a first guide plate 7*a* arranged parallel to the sliding portion 3*b*. The length L3 and the width B3 of the first guide plate 7*a* are similar to or slightly greater than those of the sliding base 3*a* of the head part 3. Preferably, the guide plate 7*a* projects beyond the sliding base 3*a* in the cutting direction S or longitudinal direction and transversely thereto by about one to two millimeters on each side.

The first neck portion 5 serves as a support or spacer which connects the head part 3 and the first guide member 7 together preferably in the middle of the sliding base 3*a* and of the first guide plate 7*a*, and keeps these parts spaced apart from one another.

The first guide plate 7*a* bounds, together with the sliding base 3*a*, a first guide space which has, in the region of the sliding portion 3*b*, a height H1 which is preferably in the range from 1 mm to 5 mm and is for example 2 mm.

In the cutting direction S, the length L2 of the first neck portion 5 increases starting from a length L2" at the first guide member 7 to a length L2' at the head part 3. The increase in the length L2 can be a linear or preferably progressive function of the altitude above the first guide plate 7A. Embedded in the first neck portion 5 is a blade 9 which preferably has a reverse trapezoidal shape. At least one, and preferably both of the legs of the blade 9 are configured as sharpened cutting edges 9*a* and project beyond the first neck portion 5 in the cutting direction S. In the exit regions of the blade 9, the first neck portion 5 is chamfered such that its width B2 decreases toward the blade 9.

Contact elements 7*b* project upward from the first guide plate 7*a*, preferably along the two longitudinal edges, the height of said contact elements being less than the height H1 of the first guide space. The height difference between the level of the underside of the sliding base 3*a* and the level of the upper edges of the contact elements 7*b* is dimensioned such that it corresponds at least approximately to the material thickness of those portions of the folding box 51 that adjoin the first guide gap 53, including a film portion (not illustrated) present there. This has the effect that the freedom of movement of the cutting device 1 orthogonally to the plane of the guide plate 7*a*, that is to say in the direction of the neck, is limited. Therefore, the sliding portion 3*b* is held in abutment against the outer wall or the outer guide wall 55 of the folding box 51 or against a film portion present there. The space available for movements of the cutting device 1 in the direction of the neck, i.e. orthogonally to the outer guide wall 55, is minimal. However, the cutting device 1 can be displaced smoothly along the first guide gap 53. In this case, the film portion to be separated is positioned gently with only a slight pressure against those portions of the outer guide wall 55 that adjoin the first guide gap 53 by the bent-up front end portion 3*c*, in the cutting direction S, of the sliding base 3*a*, before it is severed by the front cutting edge 9*a* in a defined position.

A second neck portion 15 projects downward from the bottom of the first guide plate 7*a*, the width B4 of said second neck portion 15 transversely to the cutting direction S corresponding approximately to the width of a second guide gap 63 in an inner guide wall 65 of the folding box 51 (FIG. 7). Preferably, the second neck portion 15 extends at least approximately along the entire length L3 of the first guide plate 7*a*. The second neck portion 15 connects the first guide plate 7*a* and a second guide plate 17*a* that is arranged parallel thereto and at a distance therefrom, or generally a second guide member 17. The first guide plate 7*a* and the second guide plate 17*a* bound a second guide space, the height H2 of which preferably corresponds approximately to the material thickness of the inner guide wall 65 or is slightly greater than said thickness, so as not to impede the displacement of the cutting device 1 in the cutting direction S. The width B5 of the second guide plate 17*a* can be much less than the width B3 of the first guide plate 7*a* and have for example a value in the range from 25% to 75% of said width B3. This makes it easier to insert the cutting device 1 into the two guide gaps 53, 63 in the guide walls 55, 65. Since the material of the guide walls 55, 65 is comparatively thin and flexible, the cutting device 1 can easily be inserted as a whole approximately in the middle of the guide gaps 53, 63. A larger introduction opening at the ends of the guide gaps 53, 63 is not necessary.

Figure 1:
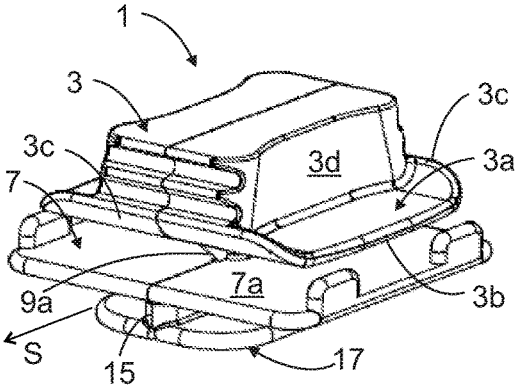
FIG. 1 shows a perspective view of a cutting device.
Figure 2:
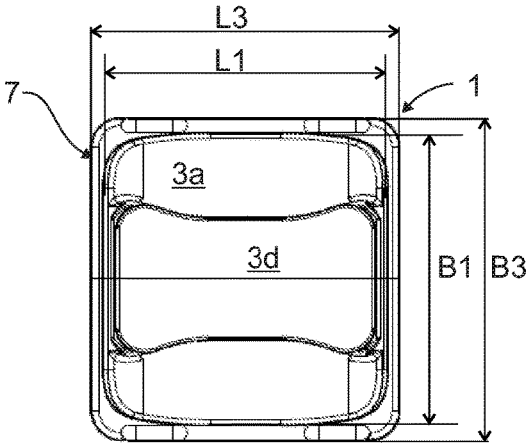
FIG. 2 shows a plan view of the cutting device from FIG. 1.
Figure 3:
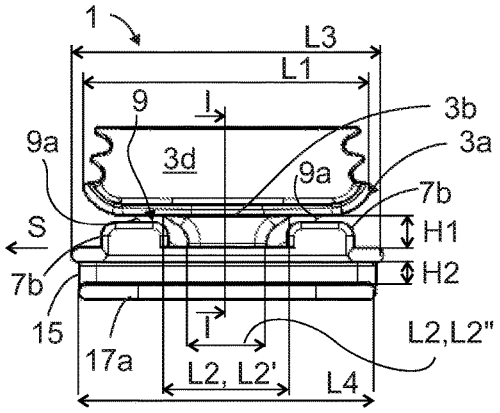
FIG. 3 shows a front view of the cutting device from FIG. 1 transversely to the cutting direction.
Figure 4:
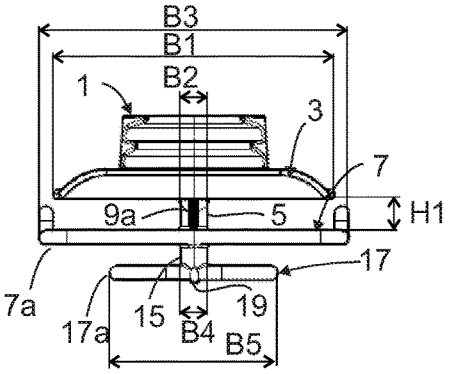
FIG. 4 shows a side view of the cutting device from FIG. 1 as seen in the cutting direction.
Figure 5:
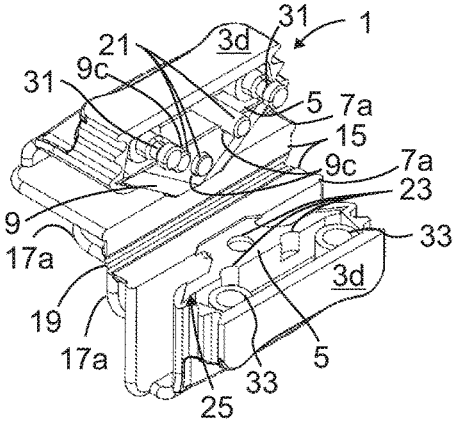
FIG. 5 shows a perspective view of the cutting device from FIG. 1 in the folded-open state.
Figure 6:
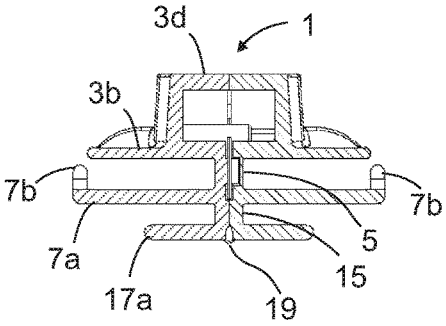
FIG. 6 shows a cross section through the cutting device along the line I-I in FIG. 3.

FIG. 5 shows the cutting device 1 in the open state, and FIG. 6 a cross section through the cutting device 1. The blade 9 is made of metal or some other hard material, such as glass-fiber reinforced plastic (GFRP), for example, and embedded in a plastics body which comprises the head part 3, the first neck portion 5, the first guide member 7, the second neck portion 15 and the second guide member 17. The plastics body comprises two halves which adjoin one another and are connected together in a parting plane dictated by the arrangement of the blade 9. Preferably, the two halves of the plastics body are connected together in an articulated manner by a film hinge 19 on the underside of the second guide plate 17*a*. This allows the plastics body to be manufactured in a cost-effective manner as a one-piece injection molding and allows the two halves to be joined together easily when the blade 9 is held in the desired position on one of the halves of the plastics body by orienting means. Alternatively or in addition, use can also be made of other connecting techniques, such as ultrasonic welding or adhesive bonding, for example, to connect the parts. In a further alternative embodiment, the blade 9 could also be inserted into the mold during the production of the plastics part and be encapsulated directly with plastic in the region between the cutting edges 9*a*. The film hinge 19 can extend along the entire length L4 of the second guide plate 17*a*. In the embodiment illustrated in FIG. 5, the orienting means comprise, on one half of the plastics body, three orienting pins 21 that project beyond the parting plane and, on the other half of the plastics body, pin receptacles 23 that correspond thereto, and, on at least one of the two halves of the head part 3, a blade bed 25 that matches the contour of the blade 9 and is bounded by a slightly higher peripheral region of the head part 3. The blade 9 comprises recesses 9*c* which are arranged and configured such that the blade 9 can be pushed over the orienting pins 21 with little play transversely to the parting plane. The orienting pins 21 define the position of the blade 9 in the parting plane and prevent movements relative to the head part 3 within the parting plane.

When the two halves of the plastics body are folded fully together so that they rest against one another, the orienting pins 21 engage in the pin receptacles 23. As a result, the two halves of the plastics body are held in a defined position relative to one another and at the same time the position of the blade 9 in the parting plane is secured.

In a similar manner to the orienting pins 21 and the pin receptacles 23, mutually corresponding connecting elements are arranged on the two halves of the plastics body, for example protruding latching pins 31 and recessed latching pin receptacles 33 which secure the two folded-together halves of the plastics body in the closed position by a form- or force-fitting connection.

FIG. 7 shows the cross section through a film dispenser. The latter comprises a folding box 51, an outer wall of which is configured as an outer guide wall 55.

The inner guide wall 65 is formed on a portion of the folding box 51 which adjoins one of the longitudinal edges of the outer guide wall 55 and is bent through about 90° multiple times parallel to this longitudinal edge. The first guide wall 55 is followed, in order, by a first connecting portion 57, a protective wall 75, a second connecting portion 59 and then the inner guide wall 65. The lengths of the first connecting portion 57 and of the second connecting portion 59 are coordinated with the cutting device 1 such that the second guide wall 65 is arranged at a distance from the first guide wall 55, said distance corresponding to the level of the second guide space when the sliding portion 3*b* of the head part 3 bears against the outside of the outer guide wall 55 and those portions of the guide walls 55, 65 that adjoin the guide gaps 53, 63 project into the associated guide spaces. The length H4 of the second connecting portion 59 is dimensioned to be as small as possible but nevertheless large enough for the second guide member 17 or the second guide plate 17*a* not to be impeded when the cutting device 1 is displaced in the cutting direction S.

The protective wall 75 protects a film roll (not illustrated) stored inside the folding box 51 in order that said film roll cannot be damaged by the cutting device 1 when the latter is displaced in the cutting direction S.

In general, corners and edges of the cutting device are rounded. This favors the smooth displacement of the cutting device 1 and likewise contributes toward the folding box 51 and the film not being damaged during displacement.

The material thickness of the folding box 51 is preferably in the range from 0.4 mm to 1 mm. This also applies to the thicknesses of the first guide plate 7*a* and of the second guide plate 7*b*.

In alternative embodiments of the folding box 51, the inner guide wall 65 could also be configured as a loose insert wall.

The comparatively low overall height of the cutting device 1 allows good utilization of the space for the film roll to be accommodated by the folding box 51. As a result, the comparatively compact folding boxes 51 can be produced.

The guide gaps 53, 63 do not absolutely have to be arranged in the middle of the guide walls 55, 65. They can also be arranged in a manner offset toward one of the longitudinal edges of the guide walls 55, 65, in which case it is necessary to ensure that the cutting device 1 can be displaced in an unimpeded manner in the cutting direction S.

The flat design of the cutting device 1, in particular of the second guide plate 17*a* ensures that, even in the case of film dispensers without a protective wall 75, a film roll stored in the dispenser cannot be damaged by the cutting device 1.

The inner guide wall 65 can be fixed in position, or secured against undesired movements in one or more directions, at one or more locations within the folding box 51. Preferably, the width and optionally also the length of the second guide wall 55 are matched to the internal dimensions of the folding box 51 such that movements of the inner guide wall 65 in the respective directions within the folding box 51 are prevented. At one or more of the long and/or short side edges of the inner guide wall 65, it is optionally possible for folded-over end portions or connecting portions 59 to be formed, which can be used as spacers or stop elements for dictating or bounding the position of the inner guide wall 65 within the folding box 51.

When the cutting device 1 has been mounted on the folding box 51, the second neck portion 15 projects further into the interior of the folding box 51 with little play through the second guide gap 63. Accordingly, the second neck portion 15 acts as an additional guide which prevents or limits movements of the cutting device 1 in translation transversely to the cutting direction S, but allows them in the cutting direction S. Since the two guide walls 55, 65 and the associated neck portions 5, 15 are arranged in a manner spaced apart orthogonally from one another, they jointly bring about improved protection against pivoting movements or undesired tilting of the cutting device 1 when, for example, a torque acts on the cutting device 1 with regard to the cutting direction S and/or with regard to the neck direction. Since the second neck portion 15 projects beyond the cutting edges 9*a* in the cutting direction S, it bears against the inner guide wall 65 at the end of the second guide gap 63 when the cutting device 1 is displaced in the cutting direction S, before the cutting edge 9*a* can damage the outer guide wall 55 at the end of the first guide gap 53.

The invention claimed is:

1. A cutting device (1) comprising a head part (3), a first neck portion (5), a blade (9) and a first guide member (7) which is connected to and held at a distance from the head part (3) by the first neck portion (5), the head part (3) and the first guide member (7) bounding a first guide space which is adapted to hold wall portions of an outer guide wall (55) of a folding box (51) that are located opposite one another and bound a first guide gap (53) of the folding box (51) such that the cutting device (1) is adapted to be mounted on the folding box (51) so as to be displaceable along the first guide gap (53), a second guide member (17) connected to and spaced apart from the first guide member (7) by a second neck portion (15), the first guide member (7) and the second guide member (17) bounding a second guide space which is adapted to hold wall portions of an inner guide wall (65) of the folding box (51) that are located opposite one another and bound a second guide gap (63) of the folding box (51).

2. The cutting device (1) as claimed in claim 1, wherein the blade (9) is embedded in a plastic body which encloses the head part (3), the first neck portion (5), the first guide member (7), the second neck portion (15) and the second guide member (17), said plastics body comprising two halves which adjoin one another and are connected together in a parting plane dictated by an arrangement of the blade (9).

3. The cutting device (1) as claimed in claim 2, wherein the two halves of the plastic body are connected together in an articulated manner by a film hinge (19) on an underside of the second guide member (17).

4. The cutting device (1) as claimed in claim 3, wherein the second neck portion (15) and the film hinge (19) extend along an entire length (L4) of the second guide member (17).

5. The cutting device (1) as claimed in claim 1, wherein the first guide member (7) comprises a first guide plate (7*a*) and the second guide member (17) comprises a second guide plate (17*a*), said guide plates being arranged parallel to one another.

6. The cutting device (1) as claimed in claim 5, wherein the first guide plate (7*a*) comprises upwardly projecting contact elements (7*b*), a height of which is less than a height (H1) of the first guide space bounded by the head part (3) and the first guide plate (7*a*).

7. The cutting device (1) as claimed in claim 5, wherein a width (B5) of the second guide plate (17*a*) is greater than a width (B4) of the second neck portion (15) and less than a width (B3) of the first guide plate (7*a*).

8. A film dispenser comprising a folding box (51) and a cutting device (1) as claimed in claim 1, wherein the folding box (51) comprises an outer guide wall (55) having a first guide gap (53) and, spaced apart therefrom, an inner guide wall (65) having a second guide gap (63), portions of the outer guide wall (55) that bound the first guide gap (53) project into the first guide space of the cutting device (1), and said portions of the inner guide wall (65) that bound the second guide gap (63) project into the second guide space of the cutting device (1), such that the cutting device (1) is displaceable in a manner guided in a cutting direction (S).

9. The film dispenser as claimed in claim 8, wherein the inner guide wall (65) is a portion of the folding box (51) that is linked to the outer guide wall (55).

10. The film dispenser as claimed in claim 8, wherein the inner guide wall (65) is configured as an insert wall.

11. The cutting device (1) as claimed in claim 1, wherein the cutting device (1) is displaceable in a cutting direction (S) along the first guide gap (53) and the second guide gap (63) of the folding box (51), the cutting direction (S) extending in the same direction as an orientation of the blade (9).

* * * * *